US009795860B2

(12) United States Patent
Rubin et al.

(10) Patent No.: US 9,795,860 B2
(45) Date of Patent: Oct. 24, 2017

(54) ROLLER SKATE BLADE AND SHARPENING THEREOF

(71) Applicant: AGILITY BLADES LTD., North Vancouver (CA)

(72) Inventors: Leonid B. Rubin, Sechelt (CA); Valery M. Nebusov, Moscow (RU); Vasili Y. Tarasenko, Burnaby (CA); Benjamin Duperthal, Vancouver (CA); George Rubin, North Vancouver (CA)

(73) Assignee: Agility Blades Ltd., North Vancouver, British Columbia (CA)

( * ) Notice: Subject to any disclaimer, the term of this patent is extended or adjusted under 35 U.S.C. 154(b) by 0 days.

(21) Appl. No.: 14/761,595

(22) PCT Filed: Jan. 13, 2014

(86) PCT No.: PCT/CA2014/000024
§ 371 (c)(1),
(2) Date: Jul. 16, 2015

(87) PCT Pub. No.: WO2014/110662
PCT Pub. Date: Jul. 24, 2014

(65) Prior Publication Data

US 2015/0335984 A1 Nov. 26, 2015

(30) Foreign Application Priority Data

Jan. 16, 2013 (WO) ..... PCT/CA2013/000040

(51) Int. Cl.
*A63C 3/10* (2006.01)
*A63B 67/14* (2006.01)
(Continued)

(52) U.S. Cl.
CPC ..... *A63C 3/10* (2013.01); *A63B 67/14* (2013.01); *A63C 1/306* (2013.01); *A63C 1/32* (2013.01); *A63C 17/06* (2013.01); *A63C 17/26* (2013.01)

(58) Field of Classification Search
CPC ..... A63C 17/0046; A63C 17/008; A63C 17/0086; A63C 17/0093; A63C 17/04; A63C 17/26
See application file for complete search history.

(56) References Cited

U.S. PATENT DOCUMENTS 938,168 A 10/1909 Nolan
1,572,567 A * 2/1926 Skorka ..... A63C 17/22 280/11.221
(Continued)

FOREIGN PATENT DOCUMENTS

DE 19705472 A1 8/1988
GB 400436 A 10/1933
(Continued)

OTHER PUBLICATIONS

International Search Report on Patentability, for Int'l Appln. No. PCT/CA2013/000040, Date of mailing Jul. 30, 2015.
(Continued)

*Primary Examiner* — Erez Gurari
(74) *Attorney, Agent, or Firm* — Dergosits & Noah LLP

(57) ABSTRACT

A roller mounting apparatus for an in-line roller skate blade comprises a body having a footware connector portion, a spacing portion adjacent the footware connector portion and a roller mounting portion adjacent the spacing portion. The roller mounting portion has roller mounts for mounting a plurality of rollers in tandem spaced apart positions such that contact points on outer surfaces of the rollers will lie on a
(Continued)

first common curved line having no portion with a radius of curvature more than about 10 m, so that a contact point on a surface of a roller immediately adjacent to any given roller is spaced apart between about 0.1 mm to about 13 mm from a line tangent to the curved line at a point defined by the contact point of the given roller. A roller blade comprising the roller mounting apparatus is also disclosed. There is also disclosed a method of sharpening an outer circumferential surface of a rotatable roller of a roller blade by causing an outer circumferential surface of a rotating grinding implement to contact the outer circumferential surface of the rotatable roller at a contact point such that a grinder plane containing the contact point and a rotation axis of the rotating grinding implement is disposed at an angle to a roller plane containing the contact point and a rotational axis of the roller. Also disclosed is a method of sharpening an outer circumferential surface of a rotatable roller by causing an outer circumferential surface of a rotating grinding implement to contact the outer circumferential surface of the rotatable roller such that the rotating grinding implement tends to drive the roller in a first direction of rotation while causing a contact surface of a rotating drive wheel to contact the roller to cause the roller to rotate in a second direction against the first direction of rotation to cause relative movement between the roller and the outer circumferential surface of the grinding implement.

17 Claims, 17 Drawing Sheets

(51) Int. Cl.

| | |
|---|---|
| ***A63C 1/30*** | (2006.01) |
| ***A63C 1/32*** | (2006.01) |
| ***A63C 17/06*** | (2006.01) |
| ***A63C 17/26*** | (2006.01) |

(56) References Cited

U.S. PATENT DOCUMENTS

| | | | | | |
|---|---|---|---|---|---|
| 1,868,548 | A * | 7/1932 | Turner | A63C 17/22 | 280/11.209 |
| 2,220,557 | A * | 11/1940 | Armand | A63C 17/06 | 280/11.221 |
| 2,644,692 | A * | 7/1953 | Ernest | A63C 17/0046 | 267/289 |
| 3,522,951 | A * | 8/1970 | Tyson | A63C 5/035 | 280/842 |
| 4,047,725 | A * | 9/1977 | Pinchock | A63C 17/0046 | 280/11.28 |
| 4,314,708 | A | 2/1982 | Zuuring | | |
| 4,699,390 | A | 10/1987 | Cote | | |
| 5,207,454 | A * | 5/1993 | Blankenburg | A63C 17/006 | 280/11.226 |
| 5,738,360 | A * | 4/1998 | Petell | A63C 17/006 | 280/11.222 |
| 5,901,970 | A | 5/1999 | Henshaw | | |
| 5,915,702 | A | 6/1999 | Kirschling | | |
| 5,964,469 | A * | 10/1999 | Grossman | A63C 17/22 | 280/11.221 |
| 6,523,835 | B1 | 2/2003 | Lyden | | |
| 7,063,335 | B1 * | 6/2006 | Galeev | A63C 17/064 | 280/11.204 |
| 2005/0206109 | A1 * | 9/2005 | Mash | A63C 5/075 | 280/87.042 |
| 2006/0108755 | A1 * | 5/2006 | Smyler | A63C 17/04 | 280/11.212 |
| 2008/0030014 | A1 * | 2/2008 | Pate | A63C 17/0046 | 280/842 |
| 2008/0067763 | A1 * | 3/2008 | Zampieri | A63C 17/0046 | 280/11.224 |
| 2010/0253057 | A1 * | 10/2010 | Arbogast | A63C 17/0006 | 280/844 |
| 2014/0034796 | A1 * | 2/2014 | Hering | A63C 17/0006 | 248/231.71 |
| 2015/0335984 | A1 * | 11/2015 | Rubin | A63B 67/14 | 280/11.222 |

FOREIGN PATENT DOCUMENTS

| | | | |
|---|---|---|---|
| GB | 1402028 | A | 8/1975 |
| GB | 1555623 | A | 11/1979 |
| WO | NO9629128 | A1 | 9/1996 |

OTHER PUBLICATIONS

International Search Report and Written Opinion of the International Searching Authority, Int'l Appln. No. PCT/CA2014/000024, Date of mailing Apr. 4, 2014.

Extended European Search Report for EP Appl No.: 14740247.3, dated Aug. 25, 2016, 11 pages.

* cited by examiner

ROLLER SKATE BLADE AND SHARPENING THEREOF

CROSS REFERENCE TO RELATED APPLICATIONS

This application is a U.S. National Phase of International Application No. PCT/CA2014/000024 filed Jan. 13, 2014, which claims priority to and the benefit of PCT/2013/000040, filed Jan. 16, 2013, the entire contents of which are incorporated herein by reference.

BACKGROUND OF THE INVENTION

1. Field of Invention

This invention relates to roller skate blades for use on artificial ice surfaces and roller mounting apparatuses therefor, and sharpening rollers thereof.

2. Description of Related Art

While ice skates have been and continue to be optimized for skating on ice, recently, ultra-high-molecular-weight polyethylene (UHMWPE or UHMW) has been developed as a substitute for conventional ice. Such material is referred to as "synthetic ice" and has unique mechanical and chemical properties. This synthetic ice is available from suppliers such as EXTRAICE, S. L. SOCIEDAD LIMITADA SPAIN of Sevilla SPAIN; Scansis A S, Norway; Ice Rink Engineering and Manufacturing, LLC of Greenville, S.C., USA; and SmartRink Canada. This synthetic ice requires little maintenance, lower capital costs and can produce lower operating costs compared to conventional ice.

Various skate blades have been designed for use on synthetic ice surfaces and there are various designs for conventional in-line roller skates. One such design is described in DE published patent application No. DE19705472 entitled "Sports Shoe with Slide Piece for Track". This application describes a skate having four in-line rollers wherein either all of the rotational axes of the rollers lie in a common plane and the frontmost and rearmost rollers have smaller diameters than the middle rollers or all rollers are about the same diameter and the central axes of rotation of the two middle rollers are disposed at a greater distance from the bottom of the foot than the two outer rollers. This causes the front and rear rollers to be raised off of the skating surface by a distance when skating in a level orientation. However, the angle of rotation required to engage the forward-most roller or the rear roller with the skating surface by pivoting forward or backward on the skate is relatively large with only four rollers and with the angles described in that application. Consequently, any forward and rearward rotational movement of the skate would appear to result in jerky movements that would not facilitate the finesse and artistic moves of an ice figure skater and would not facilitate the fine range of movement required of a hockey player or a hockey goal tender, or other precision skaters.

In addition, the rollers used on many existing in-line roller skates have flat annular running surfaces which is fine for use on high friction surfaces such as concrete or asphalt, but which are too smooth for use on synthetic ice surfaces, which have relatively low coefficients of friction. Flat annular running surfaces can slide sideways too easily on synthetic ice surfaces, which prevents skaters from performing power strokes for accelerating, from stopping effectively and from carrying out the finesse and accuracy required in performing turns and artistic moves.

The above mentioned German Patent describes rollers which have sharp circumferential edges with a half round or semi-circular shape between the edges and that this semi-circular shape is reground after a certain period of use, but provides no explanation of how to grind such a rotatable roller.

SUMMARY OF THE INVENTION

In accordance with one aspect of the invention there is provided a roller mounting apparatus for an in-line roller skate blade. The apparatus includes a body, which includes a footware connector portion, a spacing portion adjacent the footware connector portion and a roller mounting portion adjacent the spacing portion and opposite the footware connector portion. The roller mounting portion has roller mounts for mounting a plurality of rollers in tandem spaced apart positions such that contact points on outer surfaces of the rollers will lie on a first common curved line having no portion with a radius of curvature more than about 10 m, so that a contact point on a surface of a roller immediately adjacent to any given roller is spaced apart between about 0.1 mm to about 13 mm from a line tangent to said curved line at a point defined by the contact point of the given roller.

In accordance with another aspect of the invention there is provided a method of sharpening an outer circumferential surface of a rotatable roller. The method involves causing an outer circumferential surface of a rotating grinding implement to contact the outer circumferential surface of the rotatable roller at a contact point, such that a grinder plane containing the contact point and a rotation axis of the rotating grinding implement is disposed at an angle to a roller plane containing the contact point and a rotational axis of the roller.

In accordance with another aspect of the invention there is provided a method of sharpening an outer circumferential surface of a rotatable roller. The method involves causing an outer circumferential surface of a rotating grinding implement to contact the outer circumferential surface of the rotatable roller at a contact point such that a rotation axis of the roller, a rotation axis of the grinding implement and the contact point lie in a common plane, such that the rotating grinding implement tends to drive the roller in a first direction of rotation. The method also involves causing a contact surface of a rotating drive wheel to contact the roller to cause the roller to rotate in a second direction against the first direction of rotation to cause relative movement between the roller and the outer circumferential surface of the grinding implement at said contact point.

In accordance with another aspect of the invention there is provided a method of sharpening outer circumferential surfaces of rollers on an in-line skate. The method involves positioning the in-line skate in a holder operably configured to hold the in-line skate in an orientation, causing a rotating grinding implement to be successively positioned in proximity to each roller on the in-line skate and executing the method of any one of the above each time the rotating grinding implement is positioned in proximity to a roller, on the in-line skate until at least some of the rollers on the in-line skate have been sharpened.

In accordance with one aspect of the invention there is provided an apparatus for sharpening an outer circumferential surface of a rotatable roller. The apparatus includes a rotating grinding implement having an outer circumferential surface and provisions for causing the outer circumferential surface of the rotating grinding implement to contact the outer circumferential surface of the rotatable roller at a contact point such that a grinder plane containing the contact point and a rotation axis of said rotating grinding implement is disposed at an angle to a roller plane containing the contact point and a rotational axis of the roller.

In accordance with another aspect of the invention there is provided an apparatus for sharpening an outer circumferential surface of a rotatable roller. The apparatus includes a rotating grinding implement having an outer circumferential surface and provisions for causing the outer circumferential surface of the rotating grinding implement to contact the outer circumferential surface of the rotatable roller at a contact point such that a rotation axis of the roller, a rotation axis of the grinding implement and the contact point lie in a common plane, such that the rotating grinding implement tends to drive the roller in a first direction of rotation. The apparatus also includes a rotating drive wheel having a contact surface and provisions for causing the contact surface of the rotating drive wheel to contact the roller to cause the roller to rotate in a second direction against the first direction of rotation to cause relative movement between the roller and the outer circumferential surface of the grinding implement at the contact point.

In accordance with another aspect of the invention there is provided a system for sharpening outer circumferential surfaces of rollers on an in-line skate. The system includes a holder operably configured to hold the in-line skate, provisions for moving the holder to position the in-line skate in an orientation and the apparatus of any one of the above. The system also includes provisions facilitating successively positioning the rotating grinding implement in proximity to each roller on the in-line skate to cause the grinding implement to contact the outer circumferential surface of at least some of the rollers on the in-line skate to effect sharpening thereof.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention.

DETAILED DESCRIPTION

Figure 1:
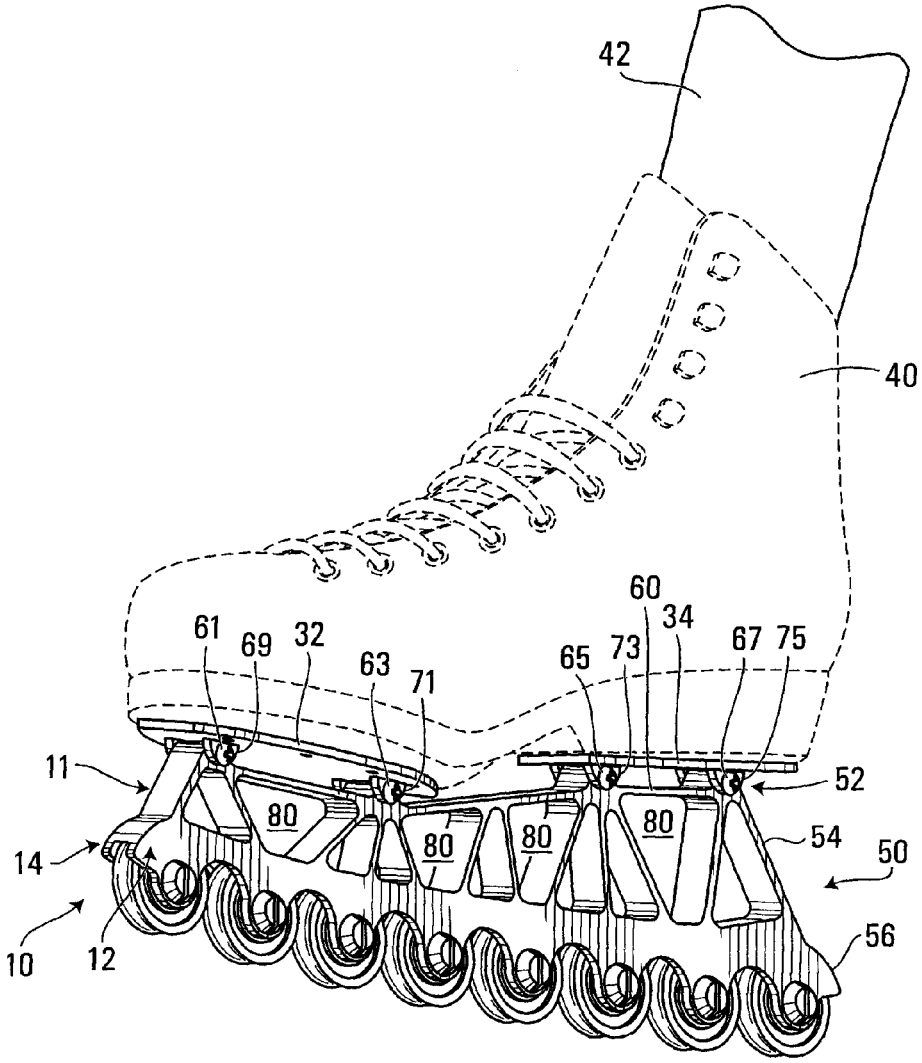
FIG. 1 is an oblique view of an in-line roller skate for use on synthetic ice surfaces.

Referring to FIG. 1, a roller skate blade for use on artificial ice surfaces such as EZ Glide 350 available from Ice Rink Engineering and Manufacturing, LLC of Greenville, S.C., USA, is shown generally at 10.

The roller skate blade 10 includes a roller mounting apparatus 11 comprising an elongated body 50 having a footware connector portion 52, a spacing portion 54 adjacent the footware connector portion 52 and a roller mounting portion 56 adjacent the spacing portion 54 and opposite the footware connector portion 52. The spacing portion 54 is located between the footware connector portion 52 and the roller mounting portion 56.

Figure 2:
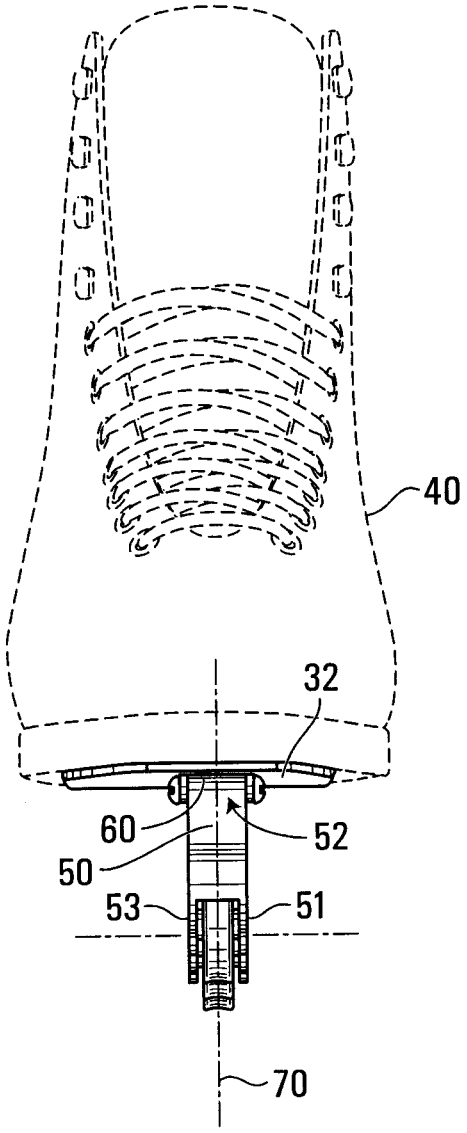
FIG. 2 is a front view of the in-line roller skate shown in FIG. 1.

Referring to FIGS. 1 and 2, in the embodiment shown, the body 50 is formed from a machined aluminum casting or an extruded aluminum form to have parallel spaced apart planar sides 51 and 53 each having a thickness of between about 2 mm to about 4 mm and spaced apart by about 3 mm to about 7 mm. The body thus may have a thickness of between about 7 mm and about 15 mm.

Alternatively, the body 50 could be formed from a hard plastic material or a combination of hard plastic and metal, for example.

Figure 3:
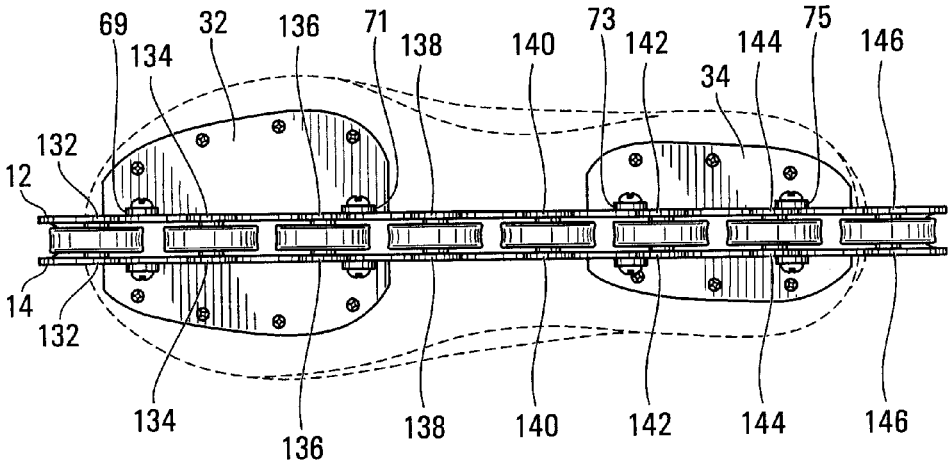
FIG. 3 is a bottom view of the in-line roller skate shown in FIG. 1.

Referring to FIGS. 1 and 2, the footware connector portion 52 has a solid top portion 60 having openings extending laterally therethrough. Referring to FIGS. 1, 2 and 3, the roller skate blade 10 further includes toe and heel footware connectors 32 and 34 having cooperating pairs of depending connectors, only one of each pair being shown at 69, 71, 73 and 75 in FIGS. 1 and 3. These depending connectors have openings that align with the openings in the footware connector portion 52 and are secured thereto by fasteners 61, 63, 65 and 67, to secure the toe and heel footware connectors 32 and 34 to the footware connector portion 52 such that they extend perpendicularly to a plane 70 of the body 50. Consequently, when the footware connectors 32 and 34 are secured to an underside of footware 40 worn by the skater, the plane 70 of the body 50 will normally be vertical as in a conventional ice-skate blade.

Referring back to FIG. 1, in the embodiment shown, the spacing portion 54 serves to provide a spacing between a skating surface on which the skater skates and the underside of the footware 40 to which the roller skate blade 10 is secured. For a hockey player this spacing may be between about 4 cm to about 9 cm, depending on footware size and skater weight. For a figure skater this spacing may be between about 3 cm to about 6 cm. For a goal tender, this spacing may be between about 2 cm to about 4 cm, to prevent a puck from entering an area between the underside of the footware and the skating surface, where it could damage the blade. The spacing employed in any embodiment may be dependant on footware size, skater weight and personal preference.

Figure 4:
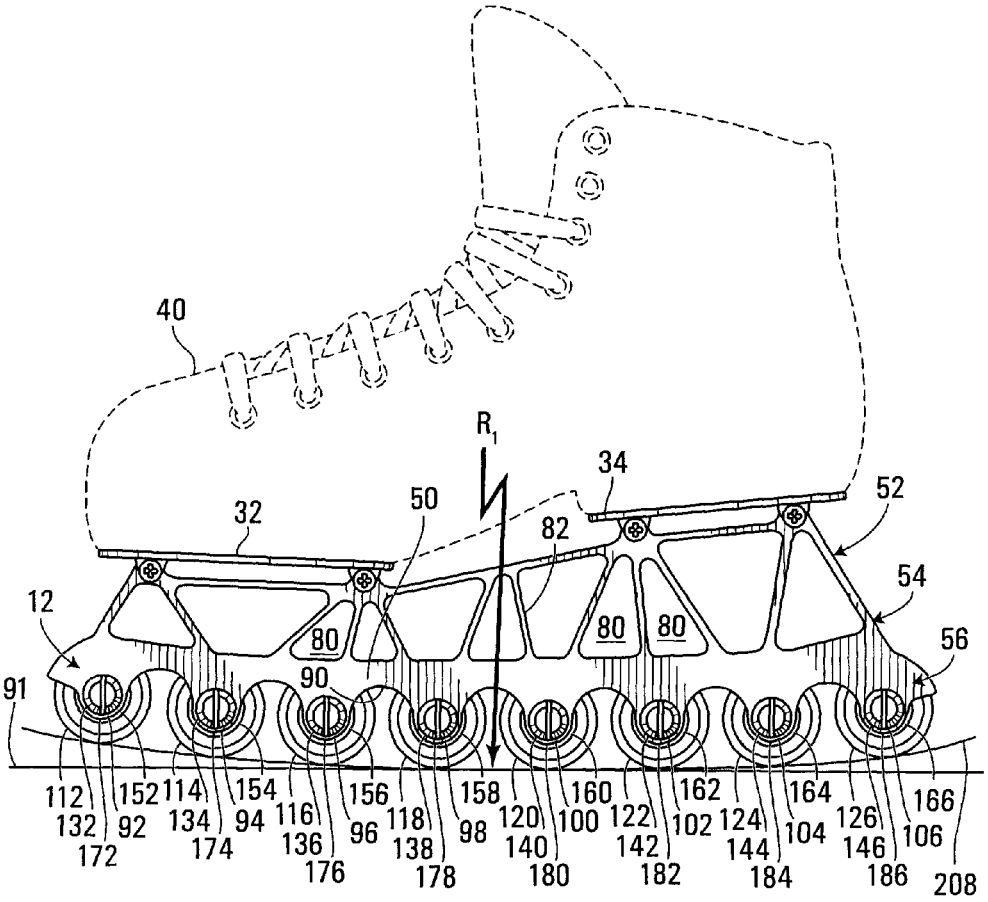
FIG. 4 is a side view of the in-line roller skate shown in FIG. 1.

Referring to FIG. 4, in the embodiment shown, the spacing portion 54 has a truss structure 82 defining a plurality of meshes 80, which serve to lighten the weight of the body 50 while providing sufficient structural strength to support the weight of the skater and the forces applied to the body 50 during skating. Alternatively, the meshes 80 need not be included and the body can be solid or of an I-beam structure with thinner portions in the areas where the meshes 80 are shown, but this could increase the weight of the roller mounting apparatus.

Referring to FIG. 1, the roller mounting portion 56 has provisions for mounting a plurality of rollers in tandem spaced apart positions. In the embodiment shown the roller mounting portion 56 includes first and second parallel spaced apart roller mounts 12 and 14. Referring to FIG. 4, each of the first and second parallel spaced apart roller mounts, only one of which is shown at 12 in FIG. 4, has a continuous skating surface-facing edge 90 having a plurality of undulations defining a plurality of projections 92, 94, 96, 98, 100, 102, 104, and 106 along the length of the body 50, to which respective rollers 112, 114, 116, 118, 120, 122, 124, and 126 are mounted. Each of the projections 92, 94, 96, 98, 100, 102, 104, and 106 has a respective opening 132, 134, 136, 138, 140, 142, 144, and 146 therein for connecting to a respective axle portion 152, 154, 156, 158, 160, 162, 164, and 166 of the corresponding roller as will be described below.

Figure 5:
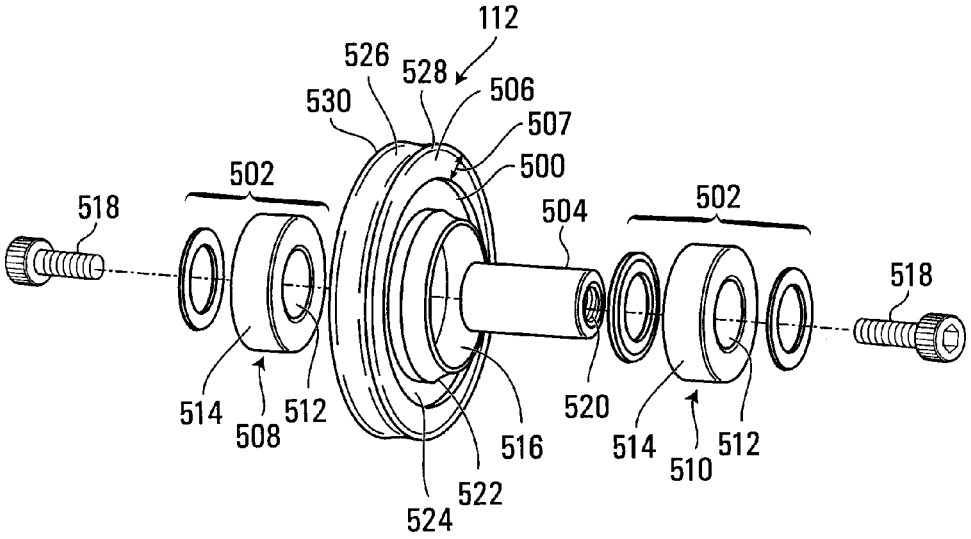
FIG. 5 is an exploded view of a roller of the in-line roller skate FIG. 1.

Referring to FIG. 5, each roller 112, has a body 500 formed of a steel alloy, anodized aluminum or other material of sufficient durability and strength, for example. The roller 112 has a bearing portion 502 for securing the roller body 500 to an axle 504 and annular running portion 506 for engaging the skating surface on which the roller 112 rolls.

In the embodiment shown, the bearing portion 502 includes first and second bearings 508 and 510 each comprising roller balls, not shown, disposed between inner and outer races 512 and 514. The outer races 514 are press-fit into corresponding recesses in the body 500 of the roller, one recess being shown at 516 in FIG. 5. The inner races 512 are connected to and are received on the roller axle 504. The roller axle 504 extends laterally between the first and second roller mounts (12 and 14 not shown in FIG. 5) and is secured in place by bolts 518 extending through respective openings in a corresponding pair of openings in the first and second roller mounts (12 and 14) and threadedly engaged with opposite sides of an axially extending threaded bore 520 of the axle 504.

In the embodiment shown, the outer races 514 may have a diameter of about 15 mm to about 18 mm and possibly 16 mm, for example. The inner races 512 may have a diameter of about 6 mm to about 10 mm and possibly 8 mm, for example. The width of the inner and outer races 512 and 514 may be about 4 mm to about 10 mm and possibly about 5 mm, for example.

In most embodiments for use on a skate, the dynamic load rating of each bearing will be no less than about 1000 Newtons, the static load rating no less than 500 Newtons and the weight of each bearing no more than about 4 grams. In addition, the bearing will desirably have a rating of at least 9 on the Annular Bearing Engineering Committee (ABEC) scale of the American Bearing Manufacturers Association (ABMA). An exemplary bearing suitable for this application is the 688zz-type bearing produced by Lily Bearing Manufacturing Co. Ltd. of Shanghai, China, or the MR688-ZZ type bearing produced by BOCA Bearing Company of Boynton Beach, Fla., USA.

The body 500 of the roller 112 has a tapered disk-shape tapering from a hub portion 522 where the body is joined to the outer races 514 of the bearings 508, 510 to a narrow outer portion 524 having a width of between about 2.8 mm to about 6.5 mm.

In the embodiment shown, the annular running portion 506 is a separate ring made from hardened steel, for example, press-fit onto the narrow outer portion 524 of the body 500 of the roller 112. As a result, the body 500 can be made from relatively lightweight, hard material such as aluminum or reinforced plastic and the annular running portion 506 can be made of hardened steel for durability and an outer annular running surface 526 thereof can be sharpened to be grooved or concaved so as to form first and second sharp edges 528 and 530 on opposite sides of the annular running surface 526. The first and second sharp edges 528 and 530 dig into a synthetic ice surface when the roller 112 is used on such surface and improve the skater's maneuverability over that available from conventional convexly-rounded or flat-shaped rollers. In the embodiment shown, the annular running surface 526 of the roller 112 has a width of approximately 2.8 mm to 6.54 mm and possibly about 3.8 mm and has an outer diameter of approximately 25 mm to 50 mm and possibly about 45 mm. The annular running surface 526 may initially be made circular cylindrical, without the groove or concave and the groove or concave can be made later by use of a specialized sharpening machine as described below, for example, adapted for creating the groove to form the first and second sharp edges 528 and 530.

The annular running portion 506 has a thickness 507 of about 1 mm to about 4 mm. The groove may be cut into the annular running surface 526 by about 0.01 mm to about 0.15 mm, for example, depending on how deep it is desired to be able to cut into the synthetic ice surface to provide the desired maneuverability.

In use, when gliding on a skate with the blade as shown in FIGS. 1 to 4, for example, the concaved annular running surfaces 526 between the first and second sharp edges 528 and 530 of the rollers in contact with the skating surface 10 will rotate over the skating surface, while the first and second sharp edges 528 and 530 dig into the skating surface. During turning or stopping maneuvers, for example, the skater leans over and the edges of the rollers on the lower side of the lean dig further into the skating surface which provides greater traction for the skater. Thus, by leaning one way or the other the skater can control the amount of traction experienced by the skate, just as with a conventional ice skate blade.

Experimental results have shown that skates with rollers as described herein have exhibited a coefficient of friction on synthetic ice when gliding, on the order of between about 0.002 to about 0.005 which is very close to the effective coefficient of friction experienced by conventional solid blade skates on conventional ice. The rollers, together with the placement of the rollers such that the outer contact surfaces thereof lie on a common curved line of a single radius or multiple radii as described below, provide for skate maneuverability on synthetic ice that is very similar to the maneuverability experienced by a skater with conventional solid blade skates on conventional ice.

Optionally, the annular running portion 506 may have an annular running surface 526 with a diameter dependent on a size of the footware to which the roller blade apparatus is intended to be attached. For example, rollers with smaller diameter annular running surfaces, i.e. smaller rollers (towards 20 mm in diameter) may be preferable for use on roller blades on small-sized footware and rollers with larger diameter annular running surfaces, i.e. larger rollers, (towards 50 mm in diameter) may be preferable for use on roller blades on large-sized footware.

Optionally, where it is desired to have a small spacing between the underside of the footware and the skating surface, smaller rollers may be used to provide for this spacing and as a result, a greater number of rollers can be employed resulting in a more ice-skate-like feel to the skate. A skate with such small spacing may be suitable for goal tenders, for example.

Generally, the greater the number of rollers, the better the "feel" of the skate approximates the "feel" of a conventional ice skate. However, for a roller skate intended for use by a hockey player, referring to FIG. 4, it is desirable not to have the most fore and aft rollers such as rollers 112 and 126 extend too far fore and aft of the footware 40 and it is desirable to keep distal surfaces 172, 174, 176, 178, 180, 182, 184, and 186 of respective projections, i.e. the most distal portions of the skating-surface-facing edge 90, at a reasonable distance such as about 5 to 15 mm from the skating surface 91 to allow the skater to present the skate to the skating surface at a high angle of attack to facilitate power strokes, sharp turns and quick stopping.

It has been found that a good approximation of conventional ice skating suitable for a hockey player can be achieved by employing about 6 to about 10 rollers, each roller having an outside diameter of between about 20 mm to about 50 mm. Smaller footware skates may employ 6 rollers, for example, while larger footware may employ 10 rollers, for example. Alternatively, a larger number of rollers having smaller diameters may be employed with any given size of footware. The greater the number of rollers, the more the "feel" of the skate approximates the "feel" of a conventional ice skate. Optionally, the same number of rollers can be employed on skates used with boots of all sizes, with the size of the rollers being varied according to the boot size, where smaller boots will use blades with smaller sized rollers and larger boots will use blades with larger sized rollers.

Figure 6:
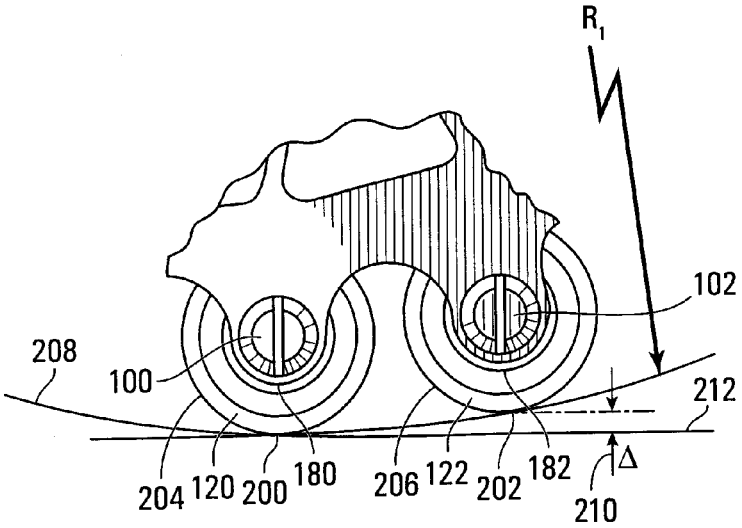
FIG. 6 is a fragmented side view of a portion of a roller mounting apparatus of the in-line roller skate shown in FIG. 1.

Referring to FIG. 6, the projections (92, 94, 96, 98, 100, 102, 104, and 106) and openings (132, 136, 136, 138, 140, 142, 144 and 146) therein are positioned relative to each other such that contact points, only two of which are shown at 200 and 202 in FIG. 6, on outer surfaces 204 and 206 of adjacent rollers 120 and 122 will lie on a first common curved line 208 having no portion with a radius of curvature $R_1$ more than about 10 m, so that a contact point such as contact point 202 on the surface 206 of a roller such as roller 122 immediately adjacent to any given roller such as roller 120 is spaced apart by a distance 210 between about 0.1 mm to about 13 mm from a line 212 tangent to the first common curved line 208, even at a point defined by the contact point 200 of the given roller 120.

This ensures that the contact surfaces of the rollers are not coplanar, i.e. are not disposed on a straight line, which would impede fore-aft rocking movement of the roller mounting apparatus 11 on the skating surface 91. By mounting the rollers to cause their contact surfaces to lie on the above-described first common curved line 208 fore-aft rocking movement of the overall blade is facilitated, allowing the skater to easily and without excessive movement, rock the skate fore and aft, as desired, to permit the skater to position their foot to permit easy pivotal movement of the skate about a vertical axis generally perpendicular to the skating surface.

Figure 7:
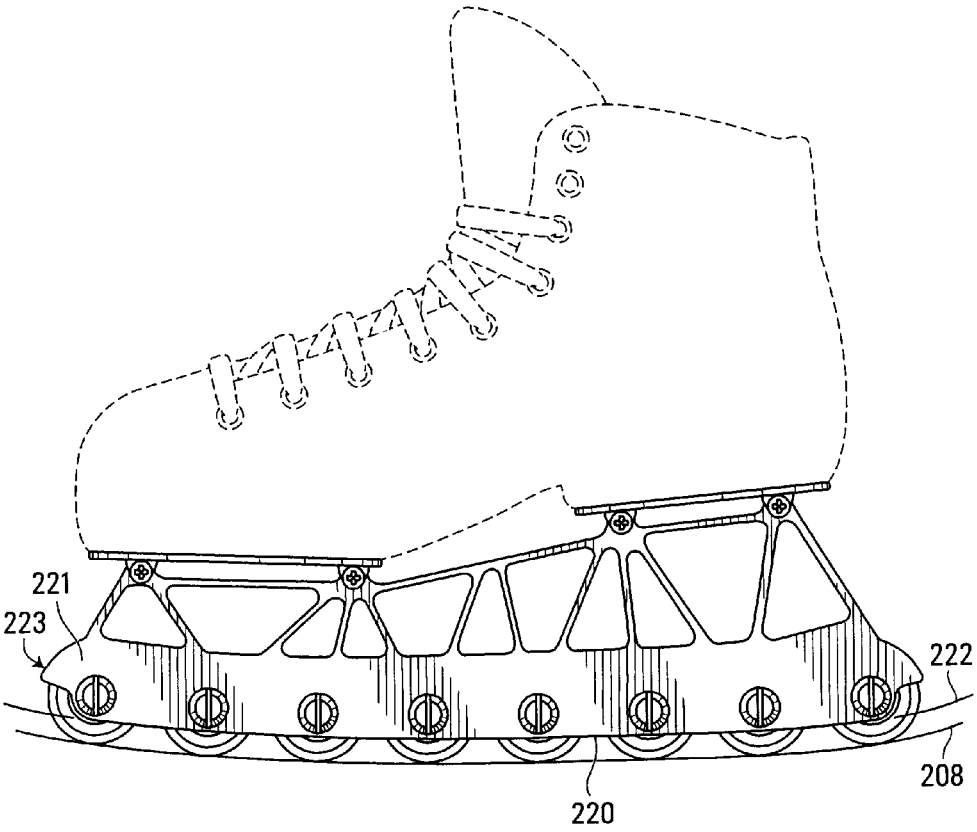
FIG. 7 is a side view of a roller mounting apparatus of an in-line roller skate according to an alternative embodiment.

While the embodiment shown in FIGS. 1, 2, 3 and 4 is seen to have a plurality of spaced apart projections 92, 94, 96, 98, 100, 102, 104, and 106 formed by undulations in the skating-surface-facing edge 90, in an alternative embodiment such as shown in FIG. 7, the body 221 of a roller mounting apparatus 223 has a continuous skating surface facing edge 220 that does not have undulations and may be gently curved to lie on a second common curved line 222 parallel and spaced apart from the first common curved line 208, for example.

The first common curved line 208 may have a constant radius of curvature as shown in FIGS. 4 and 7 or may have different zones having different radii of curvature as shown in FIGS. 8-11. For example, in the embodiments shown in FIGS. 4 and 7 the rollers are mounted to the roller skate blade such that their outer surfaces (e.g. 204, 206 in FIG. 6) follow the first common curved line 208 which has a single, constant radius of curvature. In the embodiment shown the constant radius of curvature is about 10 m. This would be suitable for a goal tender's skate, for example.

Figure 8:
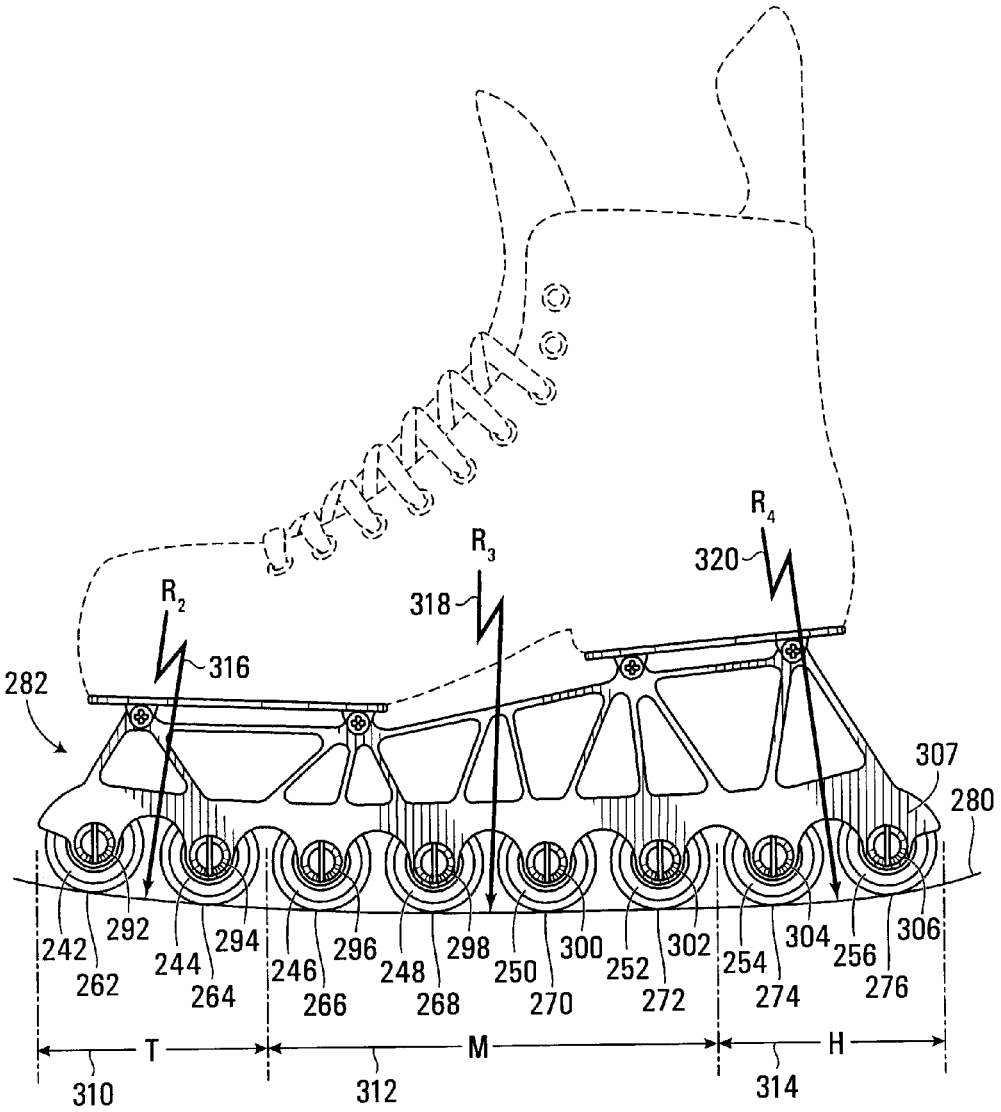
FIG. 8 is a side view of a roller mounting apparatus of an in-line roller skate according to an alternative embodiment for use as a hockey skate or figure skate.
Figure 9:
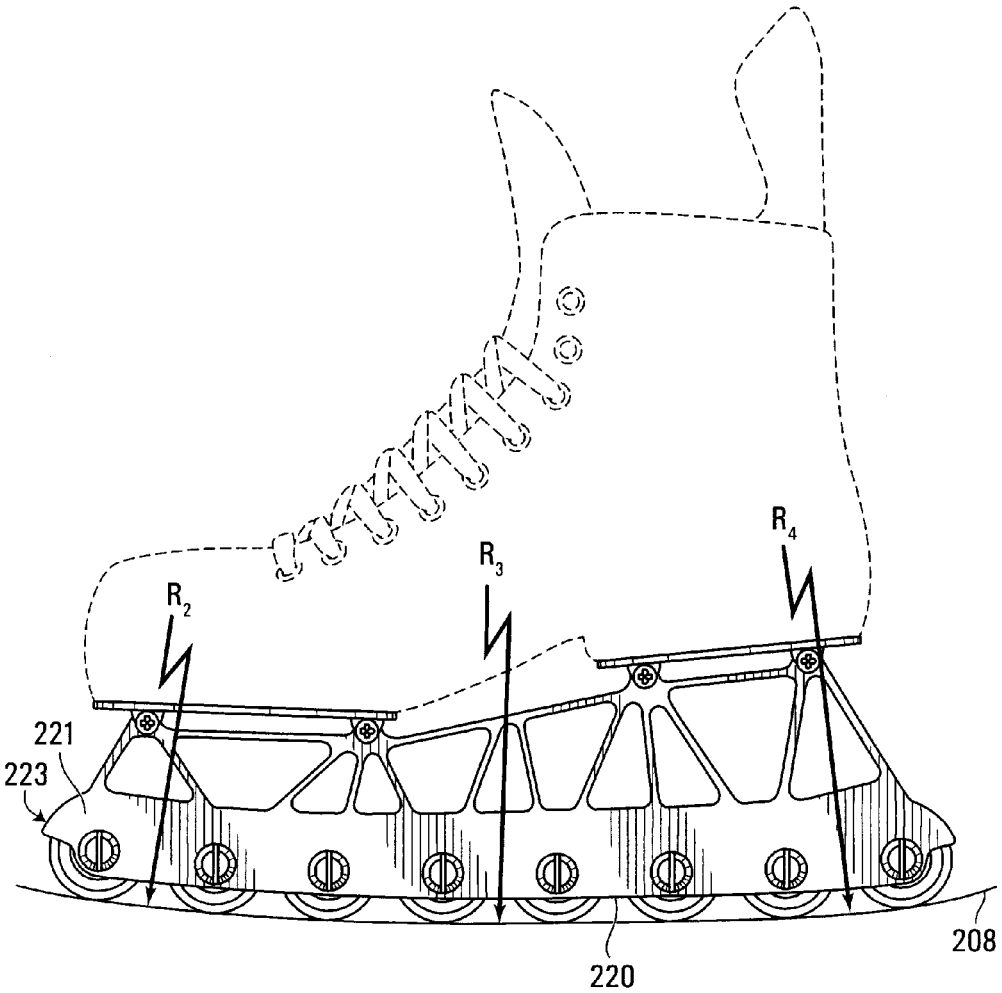
FIG. 9 is a side view of a roller mounting apparatus of an in-line roller skate according to an alternative embodiment for use as a hockey skate or figure skate.

Referring to FIGS. 8 and 9 roller mounting apparatuses for in-line skates intended for use by hockey players (and some figure skaters) have rollers positioned such that their outer surfaces 262, 264, 266, 268, 270, 272, 274, and 276 lie on a third common curved line 280 having a plurality of zones of curvature. For example, referring to FIG. 8, a roller mounting apparatus 282 for use on a hockey player's skate has roller mounting openings 292, 294, 296, 298, 300, 302, 304, and 306 on a roller mounting portion 307 and positioned such that the outer surfaces 262, 264, 266, 268, 270, 272, 274 and 276 of the rollers 242, 244, 246, 248, 250, 252, 254 and 256 will lie on the third common curved line 280.

The third common curved line has a plurality of zones of curvature including a toe zone 310 in a forward portion of the roller mounting portion 307, a middle zone 312 in a middle portion of the roller mounting portion 307 and a heel zone 314 in an aft portion of the roller mounting portion 307. The third common curved line 280 has a toe zone radius of curvature 316 in the toe zone 310, a middle zone radius of curvature 318 in the middle zone 312 and a heel zone radius of curvature 320 in the heel zone 314. The middle zone radius of curvature 318 is greater than the toe zone radius of curvature 316 and the heel zone radius of curvature 320. In the embodiment shown, the toe zone radius of curvature is between about 20 cm to about 30 cm, the middle zone radius of curvature is between about 250 cm to about 310 cm and the heel zone radius of curvature is between about 10 cm to about 30 cm.

FIG. 9 shows a smooth edge embodiment of the hockey skate shown in FIG. 8.

Figure 10:
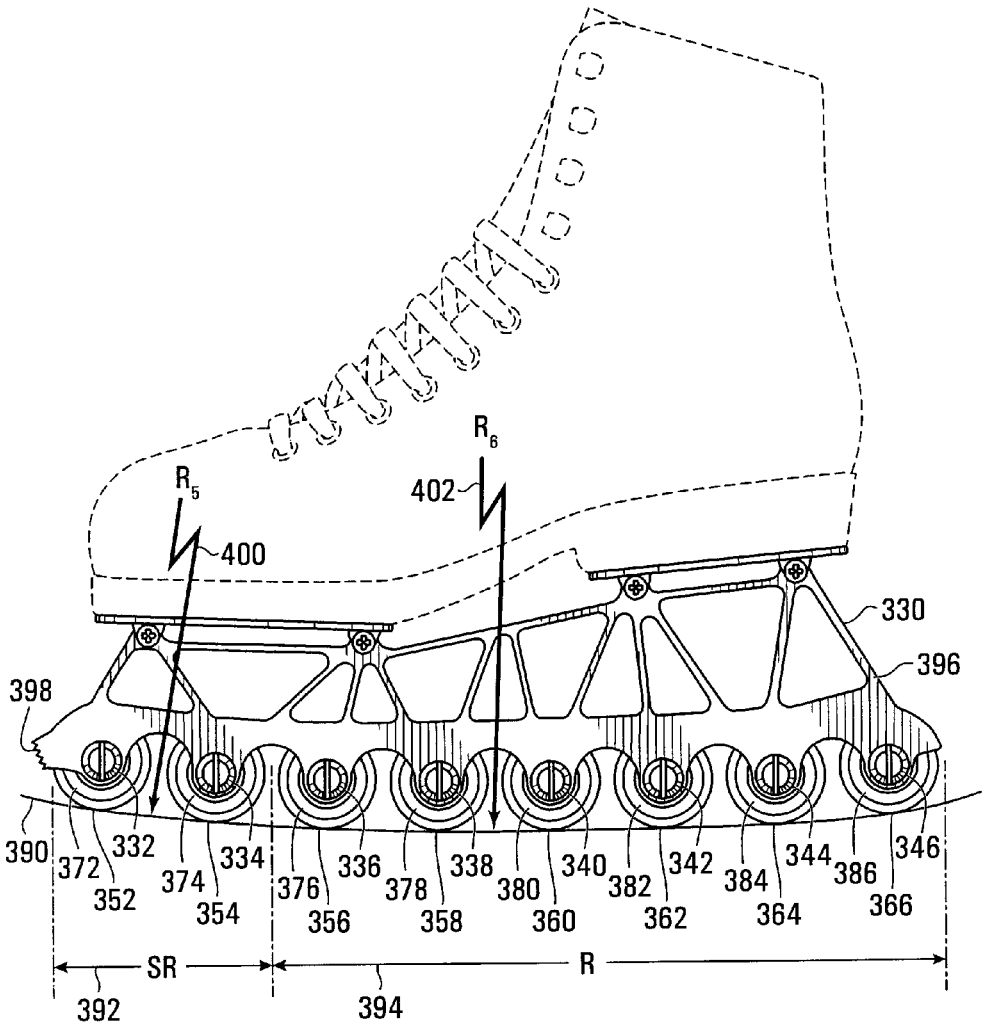
FIG. 10 is a side view of a roller mounting apparatus of an in-line roller skate according to an alternative embodiment for use as a figure skate.

Referring to FIG. 10, a roller mounting apparatus 330 for use on a figure skate has roller mounting openings 332, 334, 336, 338, 340, 342, 344, and 346 positioned such that outer surfaces 352, 354, 356, 358, 360, 362, 364, and 366 of rollers 372, 374, 376, 378, 380, 382, 384, and 386 will lie on a fourth common line 390 having a plurality of zones of curvature including a spin rocker zone 392 in a forward portion of the roller mounting apparatus 330, and a rocker zone 394 aft of the spin rocker zone 392. A body 396 of the roller mounting apparatus 330 may also include a toe pick 398 forward of the spin rocker zone 392.

In this embodiment the fourth common line 390 has at least one spin rocker zone radius of curvature 400 in the spin rocker zone 392 and a single rocker zone radius of curvature 402 in the rocker zone 394. In the embodiment shown the at least one spin rocker zone radius of curvature 400 is less than the rocker zone radius of curvature 402. More particularly, the at least one spin rocker zone radius of curvature 400 is between about 30 cm to about 70 cm and the rocker zone radius of curvature 402 is between about 180 cm to about 250 cm.

Figure 11:
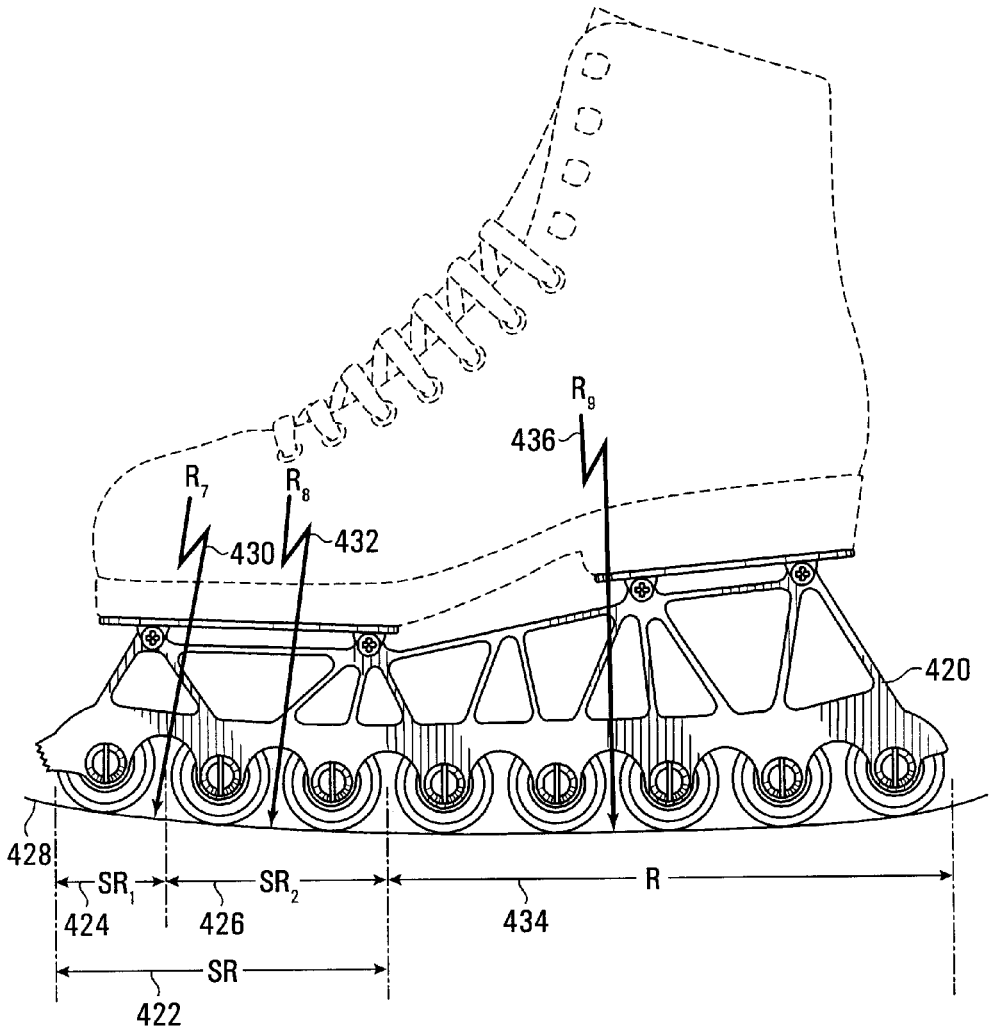
FIG. 11 is a side view of a roller mounting apparatus of an in-line roller skate according to an alternative embodiment for use as a figure skate.

Referring to FIG. 11 in an alternative embodiment a roller mounting apparatus 420 has a spin rocker zone 422 in the forward portion of the roller mounting apparatus 420 having first and second spin rocker subzones 424 and 426. The apparatus 420 also has a rocker zone 434. Contact points of the rollers in each of these zones lie on a fifth common curved line 428 that has a first spin rocker subzone radius of curvature 430 in the first spin rocker subzone 424, a second spin rocker subzone radius of curvature 432 in the second spin rocker subzone 426, and a rocker zone radius of curvature 436 in the rocker zone 434. In the embodiment shown, the first spin rocker subzone radius of curvature 430 is less than the second spin rocker subzone radius of curvature 432 and the second spin rocker subzone radius of curvature 432 is less than the rocker zone radius of curvature 436. In the embodiment shown, the first spin rocker subzone radius of curvature 430 is between about 25 cm to about 35 cm, the second spin rocker subzone radius of curvature 432 is between about 55 cm to about 65 cm and the rocker zone radius of curvature 436 is between about 240 cm to about 260 cm.

Figure 12:
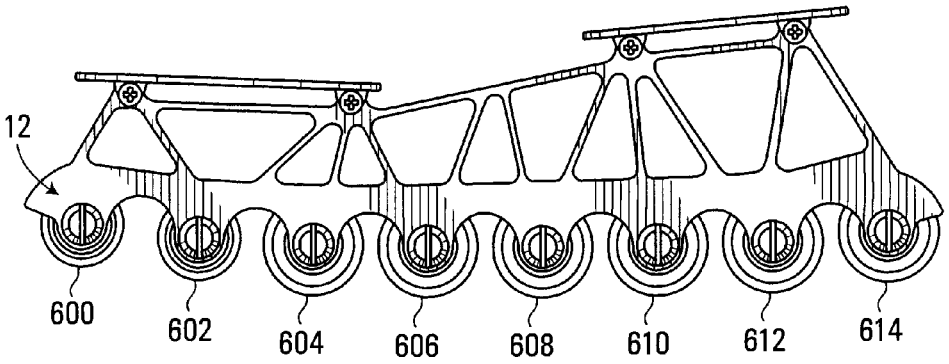
FIG. 12 is a side view of a roller mounting apparatus of an in-line roller skate according to an alternative embodiment in which front rollers are of a smaller diameter than other rollers on the skate.

In the embodiments shown in FIGS. 1-11 all of the rollers have an annular running surface (526 in FIG. 5) having a common diameter (i.e. the same diameter). However, not all of the rollers require an annular running surface having a common diameter. For example, referring to FIG. 12, rollers 600 and 602 located most forward on a roller mounting apparatus 11 having annular running surfaces 526 that are of less diameter than annular running surfaces of rollers 604, 606, 608, 610, 612 and 614 located further aft on the roller mounting apparatus.

Figure 13:
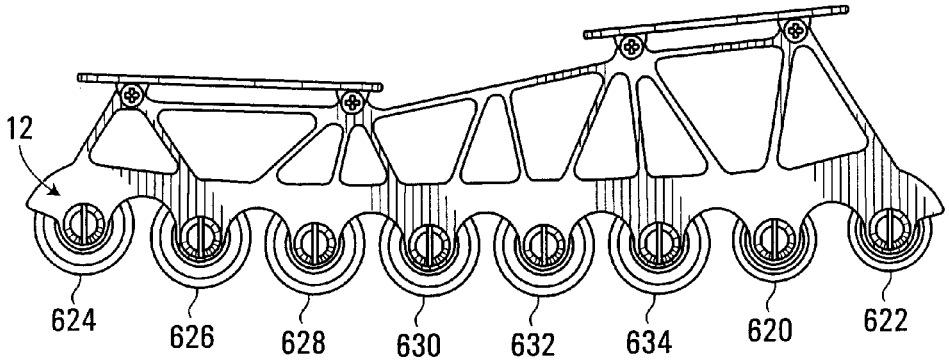
FIG. 13 is a side view of a roller mounting apparatus of an in-line roller skate according to an alternative embodiment in which rear rollers are of a smaller diameter than other rollers on the skate.

Alternatively, referring to FIG. 13 rollers 620 and 622 located most aft on a roller mounting apparatus 11 may have annular running surfaces 526 that are of less diameter than annular running surfaces of rollers 624, 626, 628, 630, 632, and 634 located further forward on the roller mounting apparatus.

Figure 14:
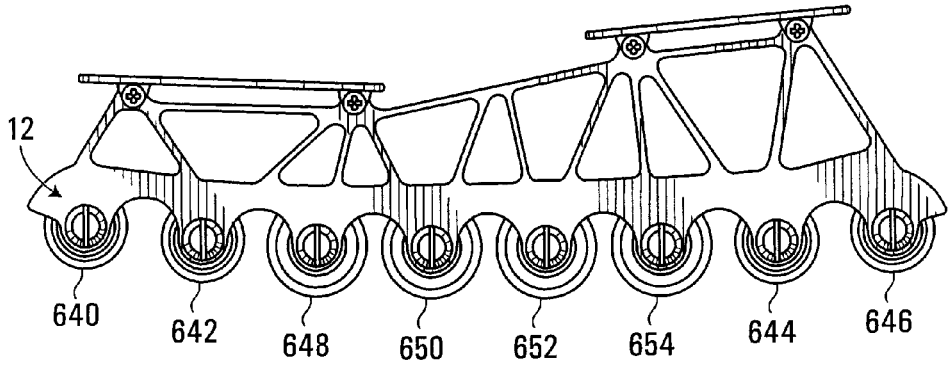
FIG. 14 is a side view of a roller mounting apparatus of an in-line roller skate according to an alternative embodiment in which front rollers and rear rollers are of a smaller diameter than other rollers on the skate.

Further alternatively, referring to FIG. 14 some of the rollers 640 and 642 in the forward portion of a roller mounting apparatus 11 and some of the rollers 644 and 646 in the aft portion of the roller mounting apparatus 11 may have annular running surfaces 526 with diameters smaller than the diameter of the annular running surfaces of rollers 648, 650, 652, and 654 in the middle of the roller mounting apparatus.

Figure 15:
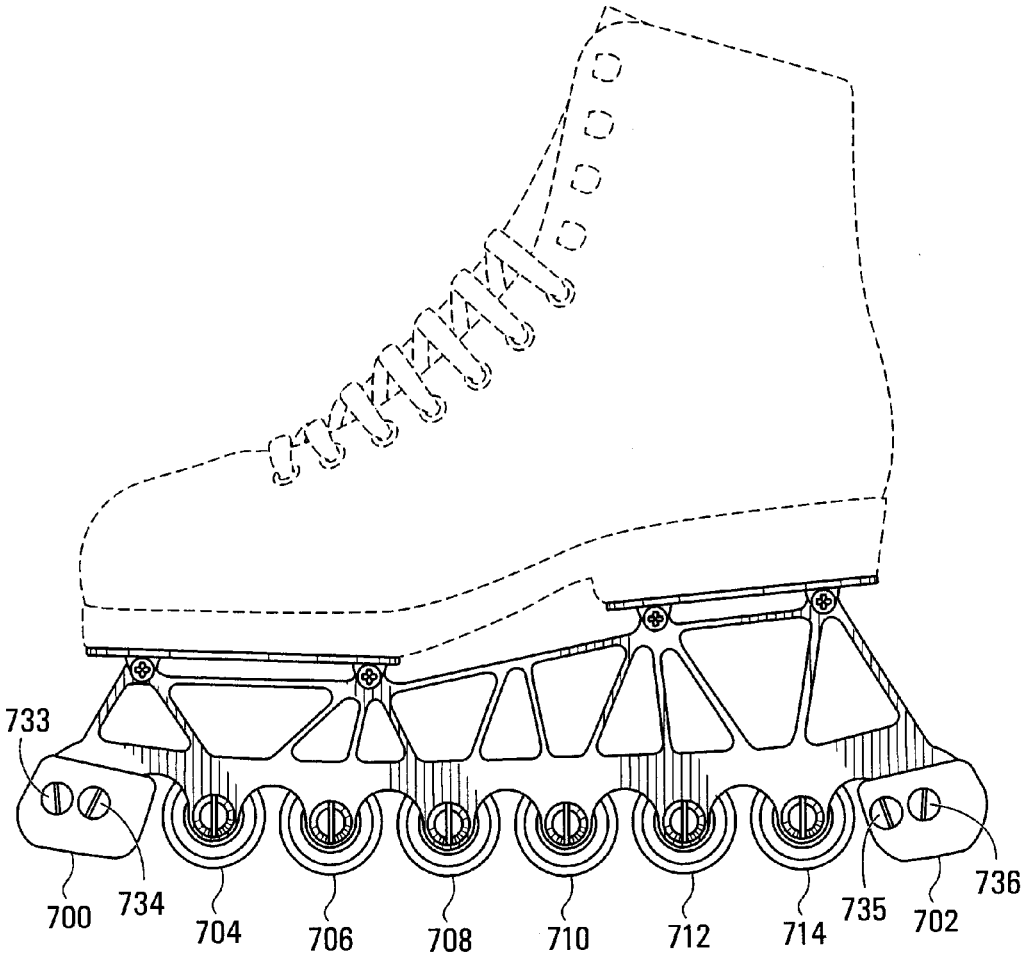
FIG. 15 is a side view of an in-line roller skate according to another embodiment of the invention wherein a blade of the in-line roller skate has toe and heel guards.

Referring to FIG. 15, in another alternative embodiment the front roller may be replaced with a toe guard 700 and/or the furthest aft roller may be replaced with a heel guard 702 while all of the remaining rollers 704, 706, 708, 710, 712 and 714 may have a common diameter such as about 20 mm to about 50 mm. The toe and heel guards 700 and 702 may be formed of hard molded plastic or hard metal, for example.

Figure 16:
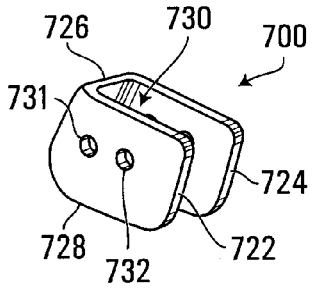
FIG. 16 is a side/rear perspective view of the toe guard shown in FIG. 15.
Figure 17:
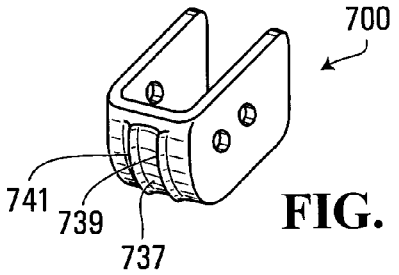
FIG. 17 is a front/side perspective view of the toe guard shown in FIG. 15.

Referring to FIG. 16, an exemplary toe guard is shown generally at 700 and is comprised of a body of hard metal having first and second parallel spaced apart side portions 722 and 724, an end wall 726 and a bottom wall 728 that define a cavity 730. The side portions 722 and 724 are spaced apart sufficiently and an interior surface of the end wall 726 and an interior surface of the bottom wall 728 are shaped complementary to the forward-most projections of the first and second roller mounts to permit the forward-most projections thereon to be received in the cavity. The first and second parallel spaced apart side portions 722 and 724 have axially aligned pairs of openings only one opening of each pair being shown at 731 and 732 in FIG. 16, extending laterally therethrough, for receiving respective fasteners such as shown at 733 and 734 in FIG. 15, for securing the toe guard 700 to the forward-most projections on each of the first and second rollers mounts (12 and 14 in FIG. 3) to prevent movement of the toe guard when skating. Referring to FIG. 17, an outer surface of the bottom wall 728 has a rounded portion 737 of a radius about the same as an adjacent roller and has side edges 739 and 741 that mimic the appearance of a roller to provide an aesthetically pleasing look to the blade, while permitting the skater to rock the skate to stand on the toe portion of the skate.

Referring back to FIG. 15, the heel guard 702 is formed in the same manner with a cavity, but the cavity of the heel guard has a shape complementary to the rearmost projections on the first and second roller mounts, to receive the rearmost projections therein. The heel guard 702 is fastened to the rearmost projection by a fasteners 735 and 736 in a manner similar to that in which the toe guard 700 is fastened to the forward-most projections.

Generally, a common feature of all of the embodiments of the roller mounting apparatus is that all of the rollers in each embodiment lie on a common curved line. The rollers are not disposed in a straight line. By placing the rollers on a common curved line, the skater can rock his/her foot forward and backward which provides a greater resolution of pivot points along the blade and provides a better pivoting ability to the skater resulting in greater maneuverability than would be provided with rollers disposed in a straight line.

The common curved line may have different zones with respective different curvatures and the number of zones and number of rollers in each zone can be selected to suit the application of the skate blade. For example, hockey skates, goal tender skates and figure skates may have different numbers of rollers, different sizes of roller and respective common lines of curvature having one or more zones of different curvature. On skate blades with a plurality of zones the skater can adjust his/her stance to engage a suitable part of the blade for the desired maneuverability.

Figure 18:
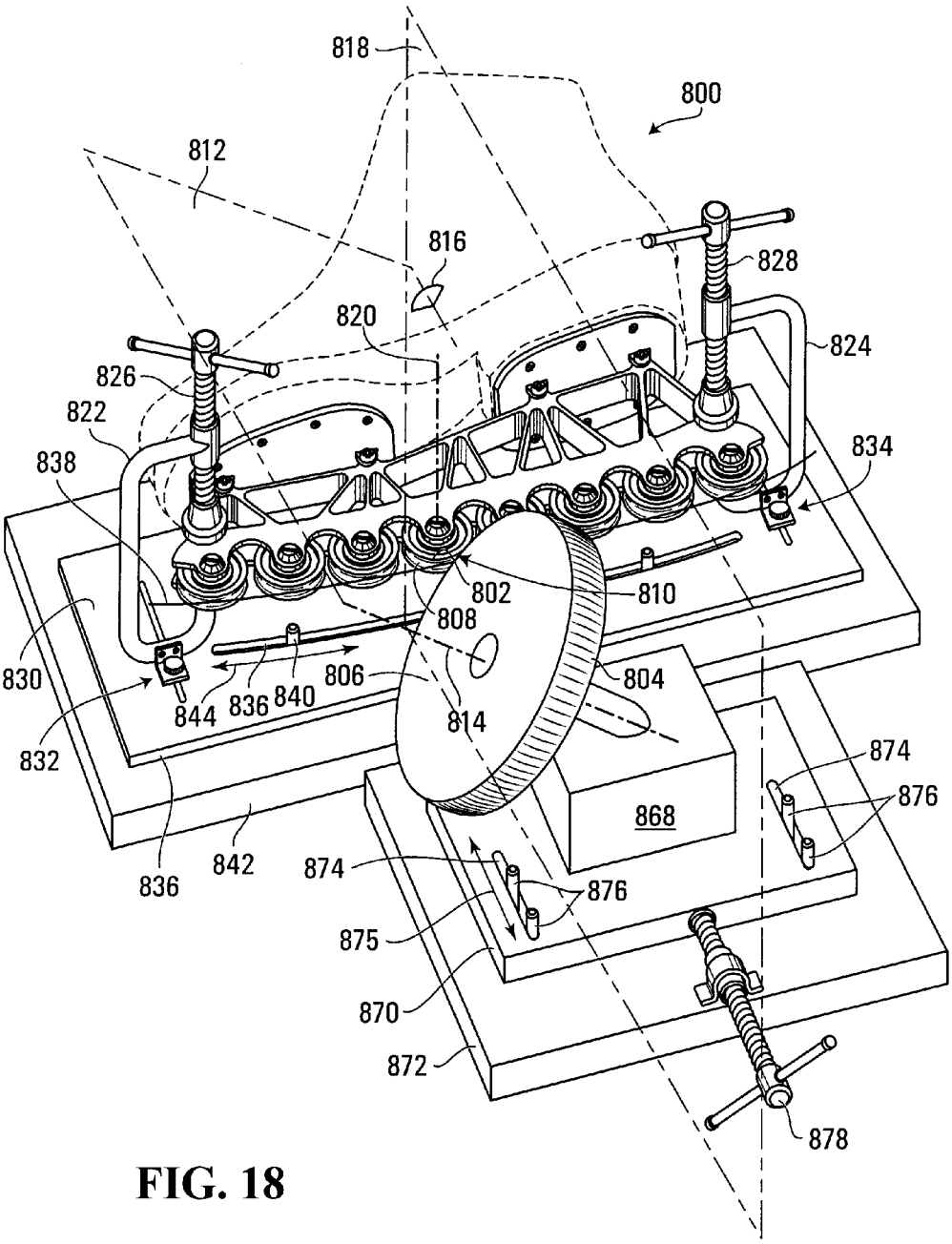
FIG. 18 is a perspective view of an apparatus for sharpening outer circumferential surfaces of rollers on an in-line roller skate according to a first embodiment of the invention.

Referring to FIG. 18, an apparatus for sharpening rollers of the roller blade apparatus described above, according to a first embodiment of the invention is shown generally at 800. Effectively, a roller such as roller 802 is sharpened by causing an outer circumferential surface 804 of a rotating grinding implement 806 in this embodiment, a grinding wheel, to contact an outer circumferential surface 808 of the rotatable roller 802 at a contact point 810 such that a grinder plane 812 containing the contact point 810 and a rotation axis 814 of the grinding implement is disposed at an angle 816 to a roller plane 818 containing the contact point 810 and a rotation axis 820 of the roller 802. Effectively, the rotation axis 814 of the grinding implement 806 is disposed at an angle to the rotation axis 820 of the roller 802 being contacted by the grinding implement 806. This is achieved by providing a holder such as shown by clamps 822 and 824, respectively, disposed adjacent the forward and aft portions of the roller blade apparatus, respectively. In the embodiment shown, the clamps are C-clamps with screw threads 826 and 828, which clamp down on opposite ends of the roller mounting apparatus. The clamps 822 and 824 are secured to a plate 830 by adjustable slides 832 and 834. The adjustable slides 832 and 834 permit movement of the clamps 822 and 824 relative to the plate 830 until they are screwed tight to the plate 830 to permit the holders (e.g. the clamps 822 and 824) to position the skate blade in an orientation such that the rollers, such as roller 802, face the grinding implement 806, such that the above-described angle between the grinder plane 812 and the roller plane 818 is generally established.

The plate 830 has a slot 836 having a shape following the common curved line 838 established by the contact points of the rollers. Spaced apart pins, only one of which is shown at 840 on a table 842 that supports the plate 830 are received in the slot 836 and confine movement of the plate 830, on which the roller blade apparatus is being held, to a path that follows the path defined by the common curved line 838. Thus, as the plate 830 is moved in the direction generally shown by arrow 844, each roller, such as roller 802, can be successively positioned in proximity to the rotating grinding implement 806 to cause the grinding implement to contact the outer circumferential surface of any desired ones of the rollers on the skate blade to effect sharpening thereof.

It will be appreciated that different plates 830 may be provided with different shaped slots 836, where the different shaped slots are shaped to correspond to the common curved lines associated with respective types of skates to be sharpened. The slot and plate arrangement provides for relative movement between the roller blade apparatus and the rotating grinding implement 806.

In the embodiment shown, the slot and plate arrangement facilitates moving the inline skate relative to the rotating grinding implement 806 in a predefined path in space however, alternatively, similar provisions can be provided to move the rotating grinding implement in predefined path in space to position it adjacent a stationary held skate blade. Alternatively both the skate blade and the grinding implement 806 may be independently moveable or cooperatively moveable to successively position the grinding implement adjacent successive ones of the rollers, such as roller 802, to be sharpened. The plate 830 and slot 836 therein thus act as a sharpening template that cooperates with the table 842 and pins 840 thereon to define the predefined path of the skate relative to the grinding implement.

Figure 19:
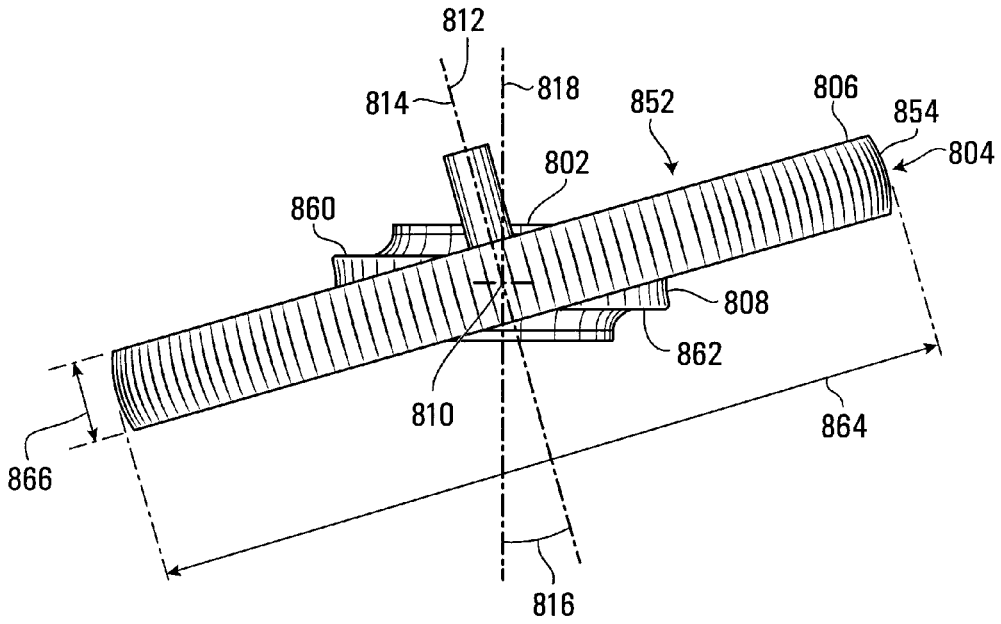
FIG. 19 is a schematic representation of a relationship between planes associated with the roller axis and a grinding implement axis of the apparatus shown in FIG. 18.

Referring to FIG. 19, the angular relationship between the roller plane 818 and the grinding plane 812 is shown more simply, whereupon the angle 816 between these planes and hence the angle between the rotating axis of the grinding implement 806 and the rotation axis 820 of the roller being sharpened is more easily identified. In this embodiment, desirably the angle is between about 20 and 80 degrees.

As can be seen from FIGS. 18 and 19, the grinding implement 806 in this embodiment has a curved shape, and more particularly, in this embodiment comprises a disk having an abrasive outer circumferential surface 804 seen best in FIG. 19. The grinding implement 806 comprises a body shown generally at 852, having a plane curve 854 defining a surface of revolution which acts as the outer circumferential surface 804 of the rotating grinding implement 806. In the embodiment shown, the plane curve is a convex line, convex relative to the rotation axis 814 of the rotating grinding implement 806. The convex line may have a radius of between about 0.1 mm to about 30 mm, but may alternatively have a radius of between about 0.5 mm to about 30 mm or between 0.1 mm to about 18 mm, each range being useful for providing an associated degree of sharpening and shape to the outer circumferential surface 808 of the roller 802 shown in FIGS. 18 and 19.

Generally, the greater the depth of the groove cut into the annular running surface 808 of the roller 802 the more bite the roller will have in the skating surface. A grinding implement 806 having a convex surface having a small radius of curvature will generally cut a deeper groove in the annular running surface. This may be desirable for sharpening the rollers on the roller skates of a hockey player, for example. A grinding implement 806 having a convex surface with a large radius of curvature will generally cut a more shallow groove in the annular running surface. This may be desirable for sharpening the rollers on the roller skates of a goal tender, for example.

As can be seen from FIG. 19, the grinding implement and skate blade are positioned such that the contact point 810 is approximately midway along the outer circumferential surface 808 of the roller, between first and second opposite sidewalls 860 and 862 of the roller. In the embodiment shown, the grinding implement (disk) 806 has a diameter 864 of about 100 mm to about 200 mm and has a thickness 866 of between about 2 mm to about 7 mm.

Referring back to FIG. 18, the apparatus includes a motor 868 for rotating the grinding implement 806 at an angular speed of between about 1000 revolutions per minute to about 5000 revolutions per minute, or more particularly, at an angular speed of about 2000 revolutions per minute to about 3000 revolutions per minute, for example. The motor 868 is mounted to a plate 870, which is mounted on a table 872. The plate 870 has slots 874 and the table 872 has pins 876 which projects upwardly from the plate and are received in the slots 874 to confine the movement of the grinding implement 806 toward and away from the rollers, as shown by arrow 875. In the embodiment shown, a screw mechanism 878 provides for controlled relative linear movement between the plate 870 and the table 872 and facilitates pressing the outer circumferential surface 804 of the grinding implement 806 against the outer circumferential surface 808 of the roller 802. In this embodiment, the screw mechanism 878 is capable of pressing the outer circumferential surface 804 of the grinding implement 806 against the outer circumferential surface 808 of the roller 802 with a force of between 1 Newton to about 300 Newtons, selectable by an operator who simply rotates the screw mechanism 878 to push the rotating grinding implement 806 against the outer circumferential surface 808 of the roller 802.

Figure 20:
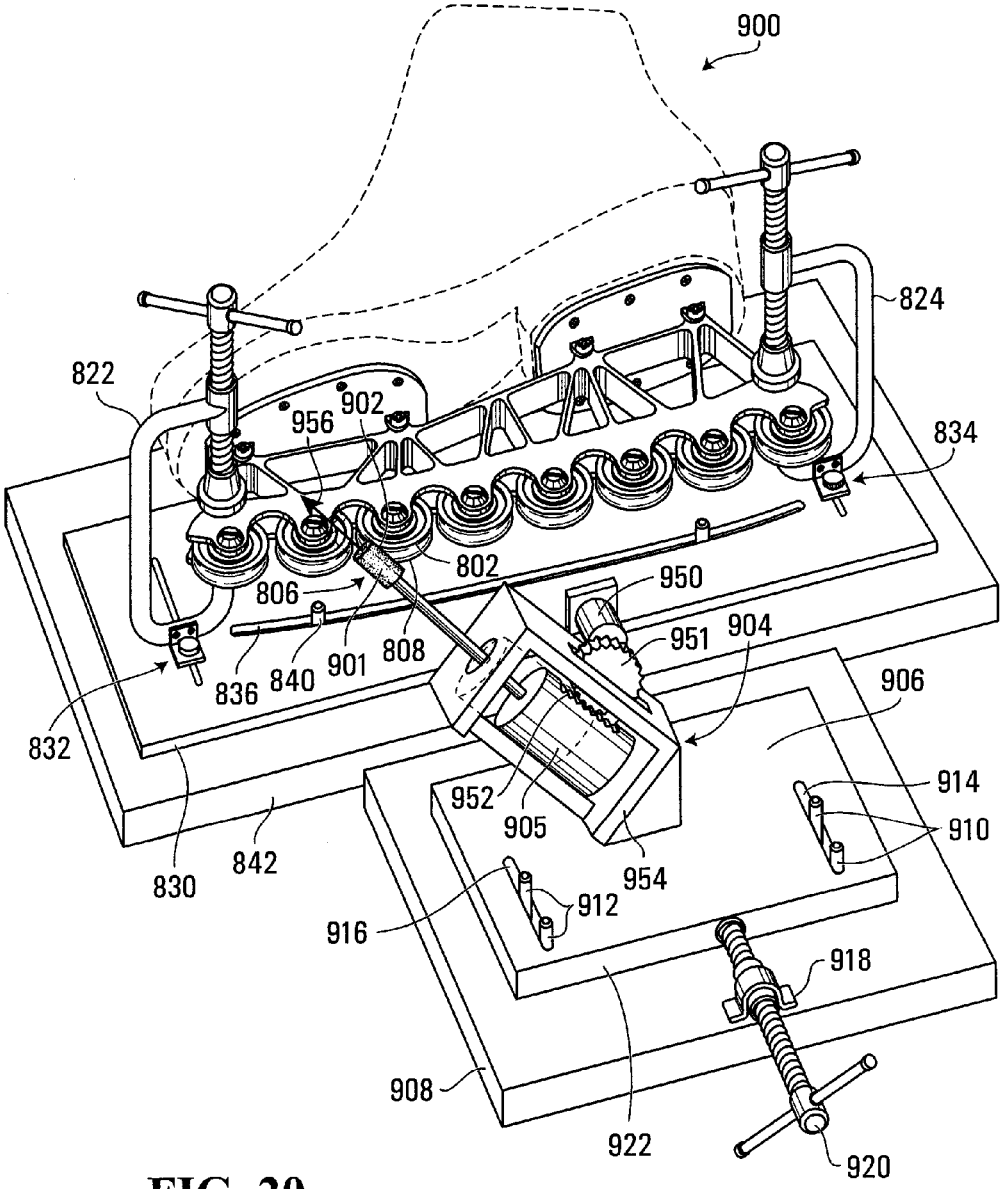
FIG. 20 is a perspective view of an apparatus for sharpening an outer circumferential surface of a rotatable roller according to a second embodiment of the invention.

Referring to FIG. 20, an apparatus for sharpening an outer circumferential surface of a rotatable roller on a roller skate blade according to a second embodiment of the invention is shown generally at 900. The apparatus includes the same clamps 822 and 824, adjustable slides 832 and 834 plate 830, table 842, slot 836 and pins 840 as shown in FIG. 18, for holding the skate blade and for positioning it into the orientation shown. Referring back to FIG. 20, in this embodiment, the grinding implement 806 comprises a body 901 having a plane curve defining a surface of revolution which defines the outer circumferential surface 902 of the rotating grinding implement 806. In this embodiment the plane curve is a straight line and thus the body 901 has a cylindrical circumferential outer surface.

As in the embodiment shown in FIG. 18, the apparatus 900 seen in FIG. 20 includes a motor mount shown generally at 904 which is secured to a movable plate 906 secured to a table 908 having pins 910 and 912 that are received in slots 914 and 916 in the plate 906.

A screw device having a threaded bushing 918 is secured to the table 908 and a screw 920 is received in the threaded bushing 918 and has an end connected to an edge 922 of the plate 906 to allow linear movement caused by turning the screw 920 to be imparted to the plate 906 to thereby push or pull the motor mount 904 and hence the motor 905 and coupled grinding implement 806, toward or away from a roller such as roller 802.

Figure 21:
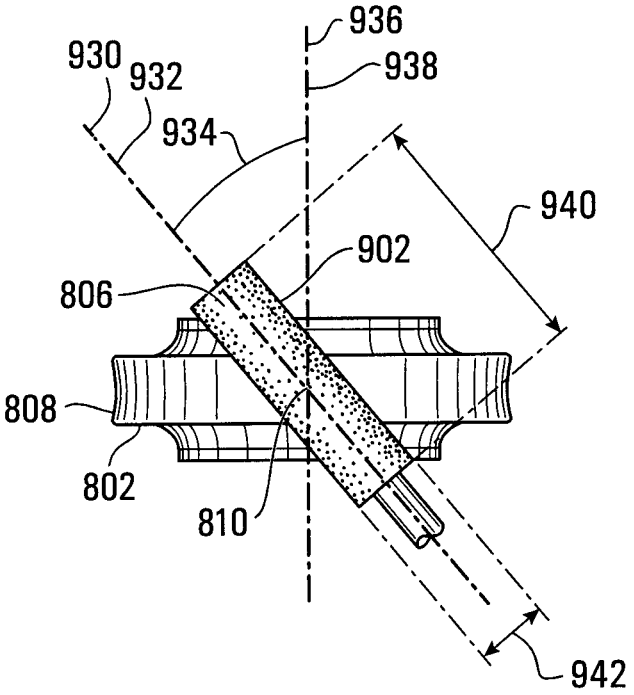
FIG. 21 is a schematic representation of a relationship between a roller plane and a grinding implement plane of the apparatus shown in FIG. 20.

Referring to FIGS. 20 and 21 the motor mount 904, plate 906, table 908 and table 842 and plate 830 are arranged in such a way that the outer circumferential surface 902 of the rotating grinding implement 806 contacts the outer circumferential surface 808 of the roller 802 at a contact point 810 such that a grinder plane 930 containing the contact point 810 and a rotation axis 932 of the rotating grinding implement 806 is disposed at an angle 934 to a roller plane 936 containing the contact point 810 and the rotational axis 938 of the roller 802. In this embodiment the angle 934 is between about 20 degrees and 80 degrees.

In this embodiment, the body of the cylindrical grinding element has a length 940 of between about 50 mm to about 150 mm but may have a length of about 50 mm to about 100 mm in another embodiment. In one embodiment the grinding implement 806 has a diameter 942 of between about 2 mm to about 40 mm and in another embodiment it has a diameter of about 4 mm to about 20 mm.

Referring back to FIG. 20, in the embodiment shown, the motor mount 904 has secured thereon a reciprocating motor 950 connected to a movement translation having a gear 951 engaged with a linear gear rack 952 connected to a casing of the motor 905. Actuation of the reciprocating motor 950 causes the gear 951 to move the linear gear rack 952 to cause the motor to move in an axial direction 956 to move the body of the grinding implement 806 axially in a reciprocating manner while the body 901 is being rotated and while it is in contact with the outer circumferential surface 808 of the roller 802.

In this embodiment, the motor 905 may cause the grinding implement 806 to rotate at an angular speed of between about 1000 to about 5000 rpm or between about 2000 to about 3000 rpm, for example. The reciprocating motor 950 may cause the motor 905 to reciprocate axially and hence to move the outer circumferential surface 902 of the grinding implement 806 axially within a range of movement in a sinusoidal fashion for example having a frequency of about 0.5 to 2 Hz, to cause the entire outer circumferential surface 902 to wear evenly.

Figure 22:
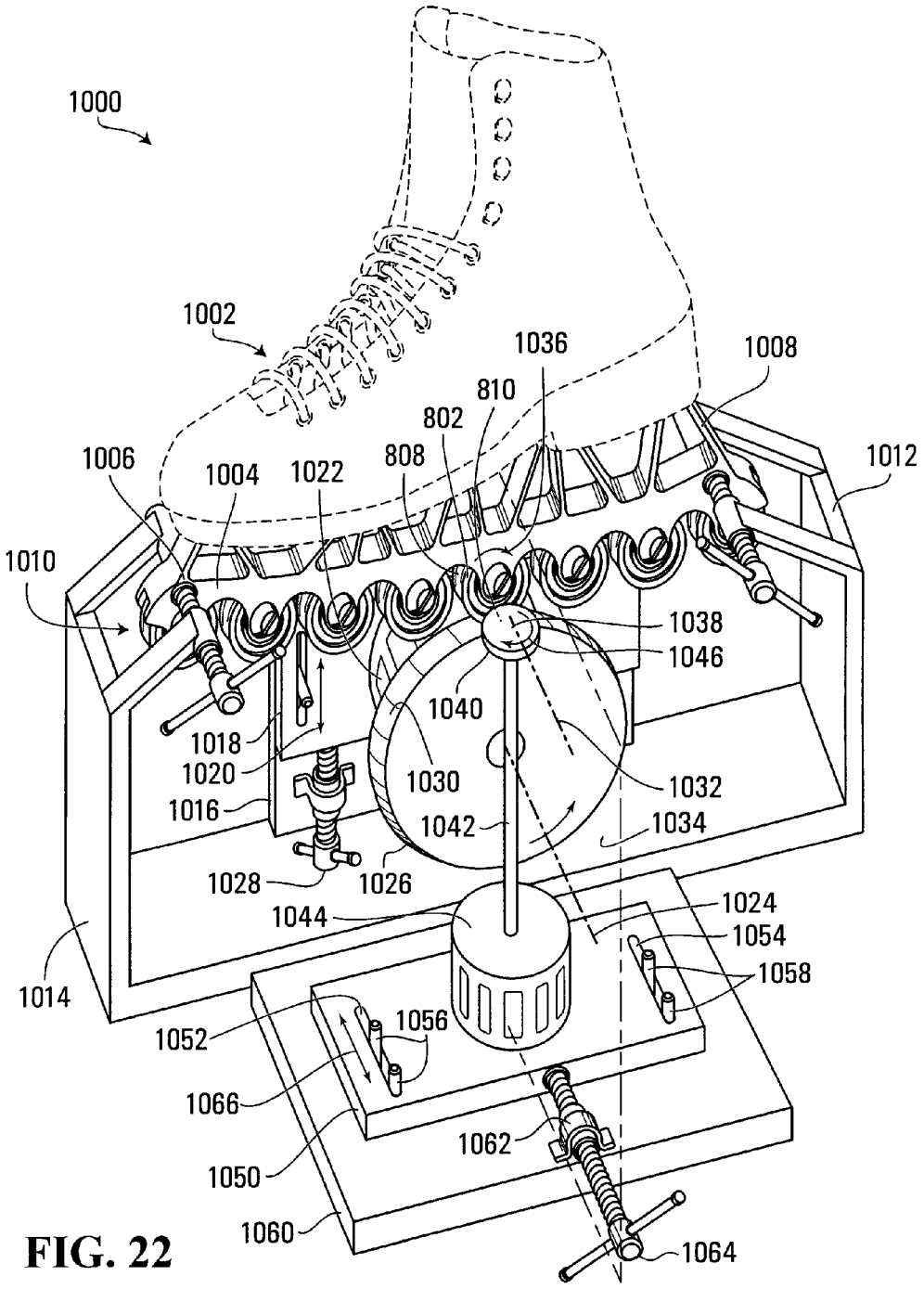
FIG. 22 is a perspective representation of an apparatus for sharpening an outer circumferential surface of a rotatable roller on an in-line skate blade according to a third embodiment of the invention.

Referring to FIG. 22, an apparatus for sharpening an outer circumferential surface of a rotatable roller on a roller blade according to a third embodiment of the invention is shown generally at 1000. In this embodiment, a skate 1002 having a roller blade 1004 has forward and aft portions 1006 and 1008 secured to clamps shown generally at 1010 and 1012, which are connected to a stand shown generally at 1014. The stand 1014 has an upstanding plate wall 1016 arranged to project in a vertical orientation generally parallel to the plane of the roller blade 1004 and to this plate wall there is secured a moveable plate 1018 operably configured for vertical movement in the direction of arrow 1020 relative to the plate wall 1016.

Secured to the moveable plate 1018 is an electric motor 1022 having a shaft, not shown, with a rotation axis 1024. To the shaft is secured a rotating grinding implement 1026, the grinding implement having the same shape and properties as that described at 806 in FIG. 18. Referring back to FIG. 22, the moveable plate 1018 is adjustably moveable by a screw mechanism 1028 which pushes the motor 1022 up or down in the direction of arrow 1020 to cause an outer circumferential surface 1030 of the rotating grinding implement 1026 to contact the outer circumferential surface 808 of the rotatable roller 802 at a contact point 810 such that a rotation axis of the roller 1032 and the rotation axis 1024 of the grinding implement and the contact point 810 all lie in a common plane 1034, such that the rotating grinding implement 1026 tends to drive the roller 802 in a first direction 1036 of rotation.

In addition, a rotating drive wheel 1038 comprising a solid body having a rubber outer circumferential surface that acts as a contact surface 1040 contacts a side wall of the roller 802. The rotating drive wheel 1038 is connected to a shaft 1042 of an electric drive motor 1044, configured to cause the shaft to rotate in a second direction of rotation 1046 at a speed of about 50 to about 200 rpm, against the first direction 1036, to cause relative opposite movement between the annular running surface of the roller 802 and the outer circumferential surface 1030 of the grinding implement 1026 at the contact point 810.

In this embodiment, the outer circumferential surface 1030 of the grinding implement is shaped in the manner shown in FIG. 19 and is thus a convex surface. This convex surface 1030 is symmetrical and contacts the entire outer circumferential surface 808 of the roller 802 between opposite side walls of the roller. Thus, the shape of the convex surface 1030 will grind an annular surface of complementary concave shape into the outer annular surface of the roller.

Referring back to FIG. 22, in this embodiment, the electric motor 1022 that rotates the grinding implement 1026 is operable to rotate the grinding implement at an angular speed of between about 1000 to about 5000 revolutions per minute or more particularly between about 2000 to about 3000 revolutions per minute, for example. The electric drive motor 1044 is configured to rotate the drive wheel 1038 at an angular speed opposite to the angular rotation speed of the grinding implement 1026 of about 50 rpm to about 200 rpm such that there will always be relative counter rotation between the outer circumferential surface 808 of the roller 802 and the outer circumferential surface 1030 of the grinding implement 1026. The contact surface of the drive wheel has a coefficient of friction relative to the roller, higher than a coefficient of friction relative to the roller, of the outer circumferential surface of the grinding implement.

In this embodiment, the electric drive motor 1044 is secured to a moveable plate 1050 having slots 1052 and 1054 in which are received pins 1056 and 1058 extending from a table plate 1060 attached to the support 1014. A screw mechanism 1062 allows a user to rotate a screw thread 1064 to move the movable plate 1050 in the direction of arrow 1066 to cause the drive wheel to be pressed against or retracted from the side wall of the roller 802 as desired. Similarly, actuation of the screw mechanism 1028 causes the grinding implement 1026 to be moved into or out of engagement with the outer circumferential surface 808 of the roller 802 with the pressure of contact against the roller being adjustable simply by actuation of the screw mechanism 1028 until a desired degree of pressure is applied by the grinding implement 1026 on the outer circumferential surface 808 of the roller 802. The screw mechanism 1028 and movable plate 1018 thus facilitate pressing the outer circumferential surface 1030 of the grinding implement 1026 against the outer circumferential surface 808 of the roller 802. The amount of pressing may be on the order of about between about 1 Newton to about 300 Newtons, for example.

Using any of the embodiments shown for sharpening the outer circumferential surfaces of the rollers, such outer circumferential surfaces can be shaped to provide edges of any desired degree of sharpness to provide for a desired degree of cutting into the synthetic ice surface to suit the application in which the roller skate blade is being used. The embodiments described can be easily implemented by modifying existing conventional-ice skate sharpening equipment to employ the features of orienting the roller plane at an angle relative to the grinder plane or to employ the features of engaging a rotating grinding implement with an outer surface of a roller to tend to drive the roller in a first direction while deliberately driving the roller by a separate drive mechanism in an opposite direction to cause the roller to have a relative rotation opposite to that of the grinding implement to facilitate shaping of the annular running surface of the roller with the grinding implement.

While specific embodiments of the invention have been described and illustrated, such embodiments should be considered illustrative of the invention only and not as limiting the invention as construed in accordance with the accompanying claims.

What is claimed is:

1. An in-line roller skate blade comprising:

a footware connector portion;

a roller mounting portion opposite the footware connector portion; and a plurality of rotatable rollers mounted on and along the roller mounting portion, the rotatable rollers being mounted in spaced-apart positions along the roller mounting portion such that contact points on outer surfaces of the rotatable rollers will lie on a first common curved line, the rotatable rollers each having a grooved annular running surface with first and second edges on opposite sides thereof;

wherein the first common curved line has a plurality of zones of curvature, the plurality of zones of curvature including a toe zone in a forward portion of the roller mounting portion, a middle zone in a middle portion of the roller mounting portion and a heel zone in an aft portion of the roller mounting portion, and wherein the first common curved line has a toe zone radius of curvature in the toe zone, a middle zone radius of curvature in the middle zone and a heel zone radius of curvature in the heel zone, and wherein the middle zone radius of curvature is greater than the toe zone radius of curvature and greater than the heel zone radius of curvature; and wherein respective ones of the rotatable rollers provide corresponding pivot points along the first common curved line such that a skater can rock the roller skate blade forward and aft to select a single one of the rotatable rollers to define a desired pivot point enabling the skater to pivot about a vertical axis generally perpendicular to a skating surface.

2. The roller skate blade of claim 1 wherein a supporting member located most forward on the roller mounting portion is one of the plurality of rotatable rollers.

3. The roller skate blade of claim 1 wherein a supporting member located most aft on the roller mounting portion is one of the plurality of rotatable rollers.

4. The roller skate blade of claim 1 wherein a contact point on a surface of a roller immediately adjacent to any given roller is spaced-apart between about 0.1 mm to about 13 mm from a line tangent to the first common curved line at a point defined by the contact point of the given roller.

5. The roller skate blade of claim 1 wherein rollers located most forward on the roller mounting portion have annular running surfaces that are of less diameter than annular running surfaces of rollers located further aft on the roller mounting portion.

6. The roller skate blade of claim 1 wherein rollers located most aft on the roller mounting portion have annular running surfaces that are of less diameter than annular running surfaces of rollers located further forward on the roller mounting portion.

7. The roller skate blade of claim 1 wherein at least two rollers located most forward on the roller mounting portion and at least two rollers located most aft on the roller mounting portion have annular running surfaces that are of less diameter than annular running surfaces of rollers located between the at least two rollers located most forward on the roller mounting portion and the at least two rollers located most aft on the roller mounting portion.

8. The roller skate blade of claim 1 wherein the rollers each have a metallic body.

9. The roller skate blade of claim 1 wherein the footware connector portion includes front and rear connector portions, and sole and heel footware connectors connected to the front and rear connector portions such that the front and rear footware connector portions extend perpendicularly to the spaced-apart positions.

10. The roller skate blade of claim 1 further including a spacing portion in between the footware connector portion and the roller mounting portion, wherein the spacing portion comprises a truss structure.

11. An in-line roller skate blade comprising:

a footware connector portion;

a roller mounting portion opposite the footware connector portion; and a plurality of rotatable rollers mounted on and along the roller mounting portion, the rotatable rollers being mounted in spaced-apart positions along the roller mounting portion such that contact points on outer surfaces of the rotatable rollers will lie on a first common curved line;

wherein the roller mounting portion has first and second parallel spaced-apart roller mounts, the roller mounts each having a continuous skating surface-facing edge, the continuous skating surface-facing edge having a plurality of undulations defining a plurality of projections to which respective ones of the rollers are mounted; and wherein respective ones of the rotatable rollers provide corresponding pivot points along the first common curved line such that a skater can rock the roller skate blade forward and aft to select a single one of the rotatable rollers to define a desired pivot point enabling the skater to pivot about a vertical axis generally perpendicular to a skating surface.

12. The roller skate blade of claim 11 wherein the continuous skating surface-facing edge lies on a second common curved line parallel to the first common curved line.

13. The roller skate blade of claim 11 wherein the rollers each comprise a bearing, a roller body rotationally secured to the bearing, and an annular surface-contacting member having an outer surface for contacting the skating surface, wherein the bearing has laterally opposite sides which are secured to respective openings in the first and second roller mounts.

14. The roller skate blade of claim 11 wherein the rollers each have a grooved annular running surface with first and second edges on opposite sides thereof.

15. The roller skate blade of claim 11 wherein rollers located most forward on the roller mounting portion have annular running surfaces that are of less diameter than annular running surfaces of rollers located further aft on the roller mounting portion.

16. The roller skate blade of claim 11 wherein rollers located most aft on the roller mounting portion have annular running surfaces that are of less diameter than annular running surfaces of rollers located further forward on the roller mounting portion.

17. The roller skate blade of claim 11 wherein at least two rollers located most forward on the roller mounting portion and at least two rollers located most aft on the roller mounting portion have annular running surfaces that are of less diameter than annular running surfaces of rollers located between the at least two rollers located most forward on the roller mounting portion and the at least two rollers located most aft on the roller mounting portion.

* * * * *